US005398708A

United States Patent [19]

Sheldon

[11] Patent Number: 5,398,708

[45] Date of Patent: Mar. 21, 1995

[54] PARTS CLEANING MACHINE

[76] Inventor: Morris W. Sheldon, 15822 Thiel Way, Grass Valley, Calif. 95949

[21] Appl. No.: 48,764

[22] Filed: Apr. 16, 1993

[51] Int. Cl.[6] ..... B08B 3/02

[52] U.S. Cl. ..... 134/86; 134/90; 134/91; 134/104.4; 134/105; 134/153

[58] Field of Search ..... 134/60, 86, 88, 89, 134/90, 91, 92, 105, 111, 115 R, 104.4, 108, 153

[56] References Cited

U.S. PATENT DOCUMENTS

| | | | |
|---|---|---|---|
| D. 275,426 | 9/1984 | Edge | D32/4 |
| D. 318,098 | 7/1991 | Rizer | D23/249 |
| 1,525,756 | 2/1925 | McKenney et al. | 134/111 X |
| 1,617,021 | 2/1927 | Mitchell | 134/60 |
| 1,691,839 | 11/1928 | Caskin | 134/60 |
| 1,804,715 | 5/1931 | Tafel, Jr. | 134/115 R X |
| 1,889,761 | 12/1932 | Schlesinger | 134/86 X |
| 2,651,311 | 9/1953 | Rule | 134/89 |
| 2,675,012 | 4/1954 | Scales | 134/89 X |
| 3,439,689 | 4/1969 | Zadron et al. | 134/104 |
| 3,659,752 | 5/1972 | Carney, Jr. et al. | 222/195 |
| 3,960,728 | 6/1976 | Otzen | 210/167 |
| 4,029,115 | 6/1977 | Wheeler | 134/111 |
| 4,056,114 | 11/1977 | Boutillette | 134/104 |
| 4,128,478 | 12/1978 | Metzger | 210/167 |
| 4,143,669 | 3/1979 | Minkin | 134/153 |
| 4,213,475 | 7/1980 | Minkin | 134/111 |
| 4,543,182 | 9/1985 | Gramse et al. | 210/95 |
| 4,589,158 | 5/1986 | Sheldon | 15/21 D |
| 4,741,361 | 5/1988 | Minkin | 134/144 |
| 4,911,190 | 3/1990 | Sheldon | 134/85 |

FOREIGN PATENT DOCUMENTS

| | | | |
|---|---|---|---|
| 222306 | 10/1924 | United Kingdom | 134/89 |

OTHER PUBLICATIONS

ADF Systems, Ltd.; Parts Washers model 300 series brochure; Apr. 1992; entire brochure.

ADF Systems. Ltd.; Accessories Oil-Water Separator brochure; Oct. 1991; entire brochure.

ADF Systems. Ltd.; Parts Washers model 10 brochure; entire brochure.

ADF Systems. Ltd.; Parts Washers series 700/800/850 brochure; Feb. 1992; entire brochure.

Blaser Swisslube Inc.; Oil Skimmer brochure; Oct. 1989; entire brochure.

Washer Mfg. Co.; Model 4872-2 brochure; entire brochure.

Intercont Products, Inc.; Spray Washers/Cabinet brochure; entire brochure.

Intercont Products, Inc.; Fluid Line Flushers flyer; entire flyer.

Intercont Products, Inc.; Automated valve body & small parts cleaner flyer; entire flyer.

Intercont Products, Inc.; Parts Tumbling Machine brochure; entire brochure.

Intercont Products, Inc.; Model EQAS 1000 flyer; entire flyer.

Intercont Products, Inc.; Rear Wheel Drive Transmission Test Machine flyer; entire flyer.

*Primary Examiner*—Philip R. Coe

*Attorney, Agent, or Firm*—Bernhard Kreten

[57] ABSTRACT

A parts cleaning machine (10) is provided which includes a cabinet (50) with a rotating carousel (60) therein for supporting articles to be cleaned and a spray bar network (80) for directing cleaning fluid (F) against articles supported upon the carousel (60). The carousel (60) is enclosed within the cabinet (50). A sink (100) is also provided which receives fluid (F) from a line (126) which taps into the spray bar network (80) to utilize cleaning fluid (F) provided by a fluid delivery system (250). The cabinet (50) includes a reservoir (90) at a bottom thereof which collects cleaning fluid (F) utilized by the spray bar network (80) and utilized within the sink (100). A filter (150) processes water from the reservoir (90) to remove contaminants from the cleaning fluid (F). The parts cleaning machine (10) can simultaneously wash articles within the cabinet (50) and within the sink (100).

19 Claims, 6 Drawing Sheets

PARTS CLEANING MACHINE

FIELD OF THE INVENTION

The following invention relates to a machine for washing articles with cleaning fluids. More particularly, this invention relates to machines for removing hydrocarbon contaminants from the individual parts of various machines such as engine components which provide both automatic and manual parts washing systems together.

BACKGROUND OF THE INVENTION

Parts washers have become very popular in cleaning engine parts so that they can be accurately inspected, handled in a sanitary manner and more easily handled for reinstallation within a motor.

Many parts washers utilize hazardous solvents and caustic detergents to cut through grease and other contaminants. With modern education in environmental concerns, the use of these solvents has fallen into disfavor. Some parts washers operate as an open system and do not provide for the recycling of fluids after use in the cleaning process. These parts washers have also fallen into disfavor due to their environmental draw backs.

These parts washers which incorporate environmentally sensitive characteristics can be divided generally into two classes of devices. Some are cabinet-style parts washers which include an enclosed cabinet. The parts are placed within the cabinet, the cabinet is sealed and then the cleaning fluid is directed against the article within the cabinet. In many cases the fluid is directed at the article under high pressure and elevated temperature while the article is rotated on a carousel.

A second class of parts washers provides an open sink and cleaning fluid is directed manually through a cleaning wand grasped by a user. Some of these cleaning wands are known to include bristles at a tip thereof to assist the user in removing contaminants from the articles being cleaned. In general, the manual sink-type parts washer is less expensive but does not thoroughly clean parts having a more complicated surface structure. However, the sink-type parts washer must be manually operated by the user. The cabinet-style parts washer does not require manual operation by a user, and is effective in cleaning most parts, yet is generally more expensive.

Accordingly, a need exists for a parts washer which incorporates the advantages of the cabinet-style parts washer with the advantages of the sink-style parts washer in a single integrated parts cleaning machine which can adequately address all of the needs of those who clean a variety of different parts on a regular basis.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 3,439,689 | April 11, 1969 | Zadron, et al. |
| 3,659,752 | May 2, 1972 | Carney, Jr., et al. |
| 3,960,728 | June 1, 1976 | Otzen |
| 4,029,115 | June 14, 1977 | Wheeler |

-continued

| PATENT NO. | ISSUE DATE | INVENTOR |
|---|---|---|
| 4,056,114 | November 1, 1977 | Boutillette |
| 4,128,478 | December 5, 1978 | Metzger |
| 4,143,669 | March 13, 1979 | Minkin |
| 4,213,475 | July 22, 1980 | Minkin |
| Des.275,426 | September 4, 1984 | Edge |
| 4,543,182 | September 24, 1985 | Gramse, et al. |
| 4,589,158 | May 20, 1986 | Sheldon |
| 4,741,351 | May 3, 1988 | Minkin |
| 4,911,190 | March 27, 1990 | Sheldon |
| Des.318,098 | July 9, 1991 | Rizer |

OTHER PRIOR ART (Including Author, Title, Date, Pertinent Pages, Etc.)

ADF Systems, Ltd.; Parts Washers model 300 series brochure; 4/92; entire brochure.

ADF Systems. Ltd.; Accessories Oil-Water Separator brochure; 10/91; entire brochure.

ADF Systems. Ltd.; Parts Washers model 10 brochure; entire brochure.

ADF Systems. Ltd.; Parts Washers series 700/800/850 brochure; 2/92; entire brochure.

Blaser Swisslube Inc.,; Oil Skimmer brochure; 10/89; entire brochure.

Washer Mfg. Co.; Model 4872-2 brochure; entire brochure.

Intercont Products, Inc.; Spray Washers/Cabinet brochure; entire brochure.

Intercont Products, Inc.; Fluid Line Flushers flyer; entire flyer.

Intercont Products, Inc.; Automated valve body & small parts cleaner flyer; entire flyer.

Intercont Products, Inc.; Parts Tumbling Machine brochure; entire brochure.

Intercont Products, Inc.; Model EQAS 1000 flyer; entire flyer.

Intercont Products, Inc.; Rear Wheel Drive Transmission Test Machine flyer; entire flyer.

Intercont Products, Inc.; Front Wheel Drive Transmission Test Machine flyer; entire flyer.

Intercont Products, Inc.; Torque Converter Flusher flyer; entire flyer.

Intercont Products, Inc.; Lock Up Torque Converter Tester flyer; entire flyer.

Intercont Products, Inc.; Parts Cleaner Model ST-1/ST-2 flyer; entire flyer.

Intercont Products, Inc.; Combination Transmission Test Machine brochure; entire brochure.

Aaladin Industries Incorporated; Parts Washers brochure; entire brochure.

American Metal Wash, Inc.; Industrial Parts Cleaning Equipment brochure, entire brochure.

Insta-Clean, Inc.; Parts Washers brochure; entire brochure.

The Hotsy Corporation; Tub Parts Washers brochure; 3/89; entire brochure.

Better Engineering Mfg., Inc.; Jet Washers brochure, entire brochure.

The parts washing brochure for the ADF parts washer model 300 teaches the use of a cabinet-style parts washer. This invention is distinguishable from the teachings of ADF in that this invention incorporates a sink with the cabinet and further provides a single reservoir for both the cabinet and the sink and allows for filtration of the single reservoir, thereby providing filtering to both the sink and the cabinet. Also, the fluid delivery system of this invention provides the cleaning fluid simultaneously to both the cabinet and the sink allowing for simultaneous use of both the cabinet and the sink for more rapid cleaning of a group of parts.

The patent to Sheldon (U.S. Pat. No. 4,911,190) teaches the use of a sink-style part washer including various attachments to encourage the rapid cleaning of the parts therein and with a filter coupled to the sink-style parts washer. The invention of this application is distinguishable from Sheldon ('190), inter alia, in that a cabinet style parts washer is also incorporated therein.

The remainder of the prior art listed above, but not specifically distinguished herein, diverge even more starkly from this invention then those devices specifically distinguished above.

SUMMARY OF THE INVENTION

The parts cleaning machine of this invention is comprised primarily of three parts: a cabinet, a sink and a cleaning fluid delivery system. The cabinet provides for automatic cleaning of articles therein. The sink provides for manual cleaning of articles therein. The fluid delivery system provides cleaning fluid to both the cabinet and the sink and collects used fluid from both the cabinet and the sink for recirculation.

The cabinet is an enclosed structure which includes a door to provide access to an interior and a carousel for supporting articles to be cleaned thereon. The carousel is rotatably mounted within the interior of the cabinet so that the carousel can rotate about a vertical axis. Spray bars are located surrounding the carousel within the interior of the cabinet in a manner which causes cleaning fluid to be directed against the articles resting upon the carousel. The carousel is coupled to a carousel motor which rotates the carousel during use.

The sink includes a basin for collecting fluid used therein and a nozzle attached to a flexible tube which receives cleaning fluid from the fluid delivery system. The basin includes a backsplash and walls surrounding the basin to prevent the fluid from flying out of the basin. A drain in the basin directs the used fluid into a reservoir for replenishing of the fluid delivery system. The nozzle is hand directable and includes bristles on a tip thereof to encourage the displacement of contaminants from articles cleaned therein.

The fluid handling system includes the reservoir which catches fluid from the basin and also collects fluid from the spray bars within the cabinet. The reservoir is cleansed of contaminants through the use of a filter. The filter circulates fluid out of the reservoir and back into the reservoir after passage through cloth, such as dirty shop towels, for the removal of contaminants from the cleaning fluid. The reservoir also includes a skimmer and scraper which remove contaminants which adhere to the surface of the skimmer. The skimmer rotates within the reservoir with part of the skimmer above a surface of the fluid and part of the skimmer below the surface. A heater is supplied within the reservoir which heats the fluid to further enhance the cleaning action of the cleaning fluid.

The reservoir includes a strainer coupled to a intake pipe which feeds water from the strainer into a pump. The pump causes the cleaning fluid to exit the receiver and be directed into the spray bars and into the flexible tube for cleaning within the cabinet and within the sink.

Various timers are utilized to control the automatic operation of the cabinet. One timer can control the rotation of the carousel and the supply of cleaning fluid to the spray bars. Another timer can allow the filter and skimmer to operate for a prolonged time period after the shut-off of the pump so that fluid within the reservoir can be further cleaned after the end of the cleaning operation.

OBJECTS OF THE INVENTION

Accordingly, it is a primary object of the present invention to provide a parts washer which can be both automatically operated and manually operated.

Another further object of the present invention is to provide a parts washer which utilizes a single cleaning fluid delivery system for both a cabinet-style automatic parts washer and a sink-style manual parts washer.

Another further object of the present invention is to provide a parts washer which couples a filter using dirty shop towels therein with a cabinet-style automatic parts washer.

Another further object of the present invention is to provide a parts washer which simultaneously automatically cleans some articles while other articles are manually cleaned.

Another further object of the present invention is to provide a parts washer which can either automatically clean an article in a first mode or manually clean an article in a second mode.

Another further object of the present invention is to provide a parts washer which is of efficient construction providing ease of maintenance, low cost operation and ease of manufacture.

Another further object of the present invention is to provide a closed-loop parts washing system which includes both a sink-style parts washer and a cabinet-style parts washer.

Viewed from a first vantage point, it is an object of the present invention to provide a device for removing surface contaminants from articles comprising in combination: a cabinet having an interior receiving the articles, the cabinet including means for automatically delivering cleaning fluid to clean the articles; a sink having a basin for supporting articles and a means for manually delivering the cleaning fluid to clean the articles; and a reservoir operatively coupled to both the sink and the cabinet, the reservoir capturing the cleaning fluid after use within the cabinet and after use within the sink.

Viewed from a second vantage point, it is an object of the present invention to provide a kit for attachment to an automatic article surface washing machine which utilizes a cleaning fluid input directed against the article and captures the cleaning fluid in a reservoir for recirculation of the cleaning fluid, the kit including: means for interfacing with the cleaning fluid input to draw a portion of the cleaning fluid away from the automatic washing machine; a nozzle coupled to the interfacing means for directing the fluid against an article; a basin collecting the fluid delivered from the nozzle; and a means to return the fluid from the basin back into the reservoir; whereby a user can utilize the automatic machine to deliver cleaning fluid for manual cleaning of articles having characteristics which making cleaning performance of the automatic machine inadequate.

Viewed from a third vantage point, it is an object of the present invention to provide a method for removing surface contaminants from articles, including the steps of: providing a cabinet with an interior including an automatic fluid delivery system with means for directing the fluid against the articles, a reservoir collecting the fluid after its use against the article and a sink including a manual fluid delivery system with means for directing the fluid against the articles and an outlet returning the fluid used by the directing means back into the reservoir; analyzing an article to be washed to determine if automatic fluid delivery can adequately remove surface contaminants therefrom; utilizing the cabinet if said analyzing step indicates effective decontamination; and utilizing the sink if said analyzing step indicates ineffective decontamination.

These and other objects will be made manifest when considering the following detailed specification when taken in conjunction with the appended drawing figures.

DESCRIPTION OF PREFERRED EMBODIMENTS

Figure 1:
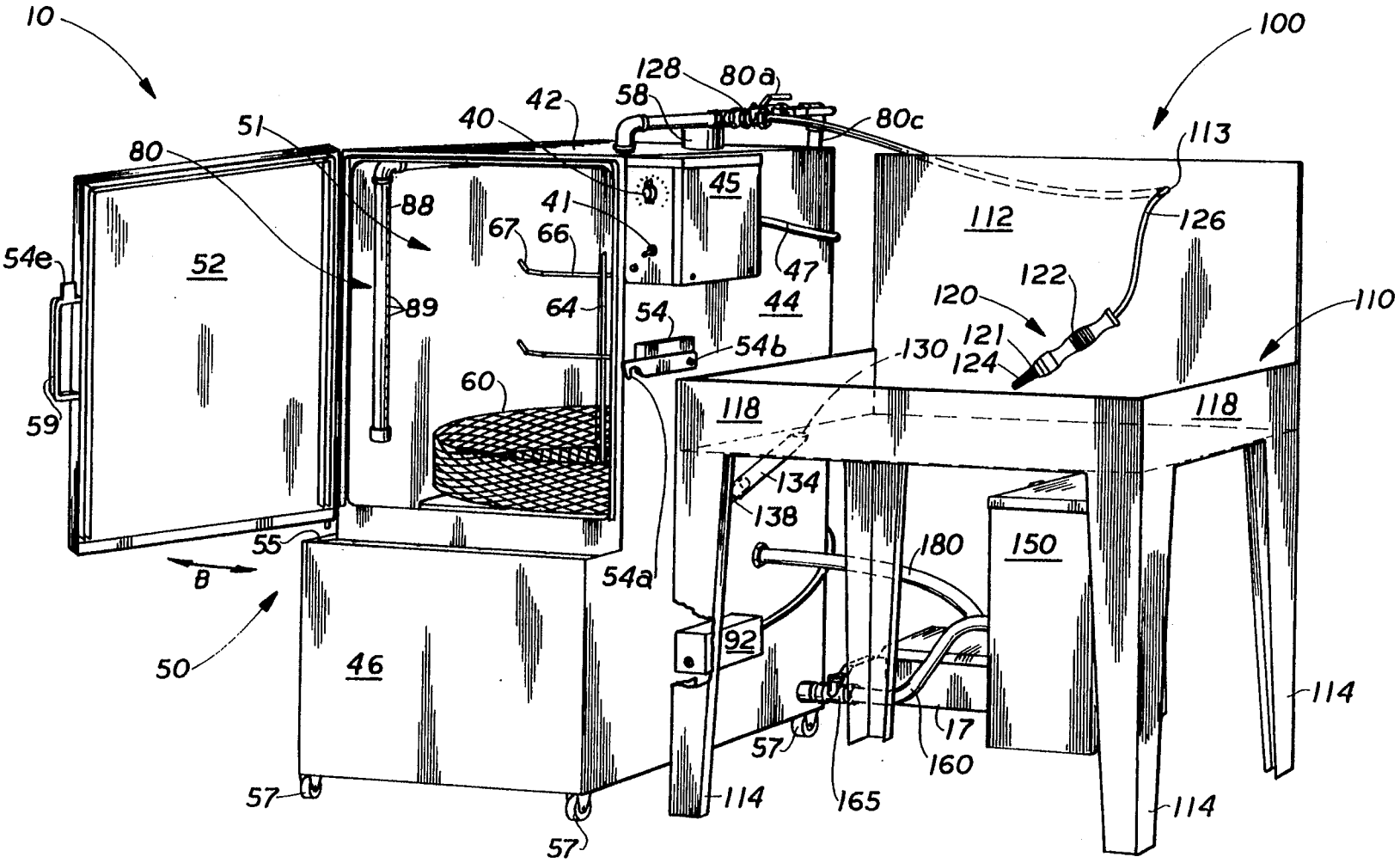
FIG. 1 is an isometric view of the device of this invention.

Referring to the drawings wherein like reference numerals represent like parts throughout, reference numeral 10 (FIG. 1) is directed to a parts washer for removal of contaminants from an article, such as an engine part contaminated with hydrocarbons.

Figure 3:
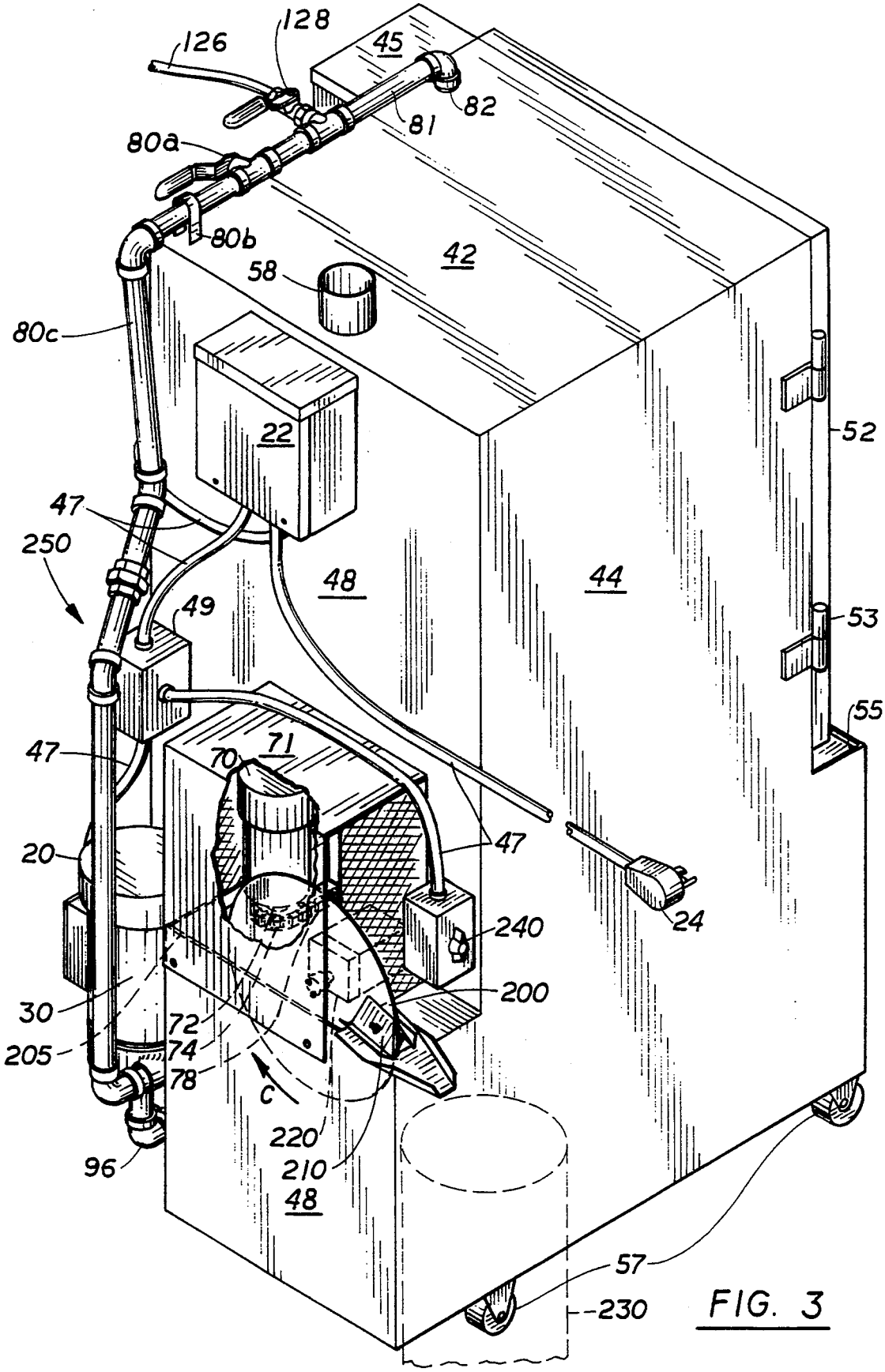
FIG. 3 is an isometric view of the cabinet portion of this invention viewed from a rear corner and revealing further details of the cabinet portion.

In essence, and referring primarily to FIG. 1, the parts washer 10 includes a cabinet 50, a sink 100, a filter 150 and a skimmer 200 (FIG. 3). The cabinet 50 has a carousel 60 located therein which is rotated by a carousel drive motor 70 (FIG. 3). A spray bar network 80 supplies cleaning fluid F (FIG. 4) to an interior 51 of the cabinet 50. A reservoir 90 (FIG. 4) is located in a bottom of the cabinet 50 which collects the cleaning fluid F after it is sprayed against articles resting on the carousel 60.

The sink 100 includes a basin 110 for collecting the cleaning fluid F after use and for supporting the articles during cleaning. A brush 120 includes a nozzle 121 therein which is in fluid communication with the spray bar network 80 such that cleaning fluid F can be diverted from the spray bar network 80 and directed through the nozzle 121 of the brush 120. A drain 130 located in the basin 110 returns the cleaning fluid F back into the reservoir 90.

The filter 150 includes a filter inlet 160 (FIG. 2) which is in fluid communication with the reservoir 90 and a filter motor 170 which causes the cleaning fluid F within the reservoir 90 to be drawn through the filter 150. A filter outlet line 180 returns the filtered cleaning fluid F back into the reservoir 90.

The skimmer 200 (FIG. 3) is in fluid communication with the reservoir 90 such that sludge-like contaminants which float are removed thereby. A scraper 210 impacts the skimmer 200 removing the sludge adhering thereto. A skimmer motor 220 causes the skimmer 200 to rotate and the scraper 210 directs the sludge to a receptacle 230 outside of the cabinet 50.

Valves **80*a*, 128, 165 direct fluid flow within the parts washer 10. A spray bar motor 20 (FIG. 2) and spray bar motor pump 30 (FIG. 2) cause the fluid F within the reservoir 90 to be pumped out to the spray bar network 80 and to the brush 120. Motors 170, 20 cause pumps 175, 30 to supply the cleaning fluid F to different portions of the parts washer 10. Together, these components define a fluid delivery system 250 for the parts washer 10**.

More specifically, and referring in detail to FIGS. 2 through 6, details of the operation of the cabinet 50 are described. The cabinet 50 is essentially a tetragonal construct with its longest dimension oriented vertically. The cabinet 50 is defined by a top wall 42, bottom wall 43, two side walls 44, front wall 46 and back wall 48. The cabinet 50 is hollow such that the exterior walls 42, 43, 44, 46, 48 separate an interior 51 of the cabinet 50 from an exterior thereof. A door 52 is located on the front wall 46 and pivots (about arrow B) on hinges 53 to provide access to the interior of the cabinet 50 for loading and unloading of articles to be washed. A latch 54 holds the door 52 tightly shut during operation of the parts washer 10.

The latch 54 includes a notch **54*a* which pivots about a pivot 54*b* allowing the notch 54*a* to grasp a tab 54*e* extending from an edge of the door 52 opposite the hinges 53. Thus, when the door 52 is closed with seals 52*a* of the front wall 46 adjacent the door 52, the notch 54*a* can be pivoted until it overlies the tab 54*e*. This causes the door 52 to address the seal 52*a*. In this way, the latch 54 prevents cleaning fluid F from passing out of the door 52 during operation. The door 52 includes a handle 59 for manual pivoting of the door 52**.

In an alternative embodiment, operation of the parts washer 10 is interrupted by a switch coupled to a detector 26 which detects when the latch 54 is open. This detector 26 prevents the cabinet 50 from operating with the door 52 open to enhance the safety and environmental effect of parts washer 10 operation.

Directly below the door 52 is a drip tray 55. The drip tray 55 is essentially a trough which has an open side facing upwards to catch cleaning fluids F that may run underneath the door 52 or be released from the cabinet 50 during opening of the door 52. The drip tray 55 includes drain holes 56 in a bottom thereof which drain the cleaning fluid F down into the reservoir 90 (see FIG. 4).

The bottom wall 43 of the cabinet 50 is supported on wheels 57 allowing the cabinet 50 to be easily moved on a hard surface. A vent 58 is located in the top wall 42 of the cabinet 50. The vent 58 prevents pressure from building up within the cabinet 50.

The carousel 60 is preferably a circular basket formed of rigid foraminous material. The carousel 60 includes a spider 68 (FIGS. 4 and 5) which supports the carousel 60 structurally and ensures that when articles are placed on top of the carousel 60 for cleaning, the carousel 60 can support the articles without substantial deflection of the carousel 60.

A parts tree 64 extends up from a geometric center of the carousel 60 and is manually removeable from the carousel 60 and the spider 68 when not required for supporting articles to be cleaned. The pole 64 is received within a hollow arbor 60*a* at a geometric center of the carousel 60. The pole can be manually removed by displacement along arrow D. The parts tree 64 includes hangers 66 which extend horizontally away from the parts tree 64 and which have tips 67 which turn upwards slightly. The hangers 66 and tips 67 can support tall articles resting upon the carousel 60 in a vertical orientation and can independently hold smaller articles in a manner allowing them to be suspended for greater cleaning fluid F contact against the article during washing within the cabinet 50.

Figure 4:
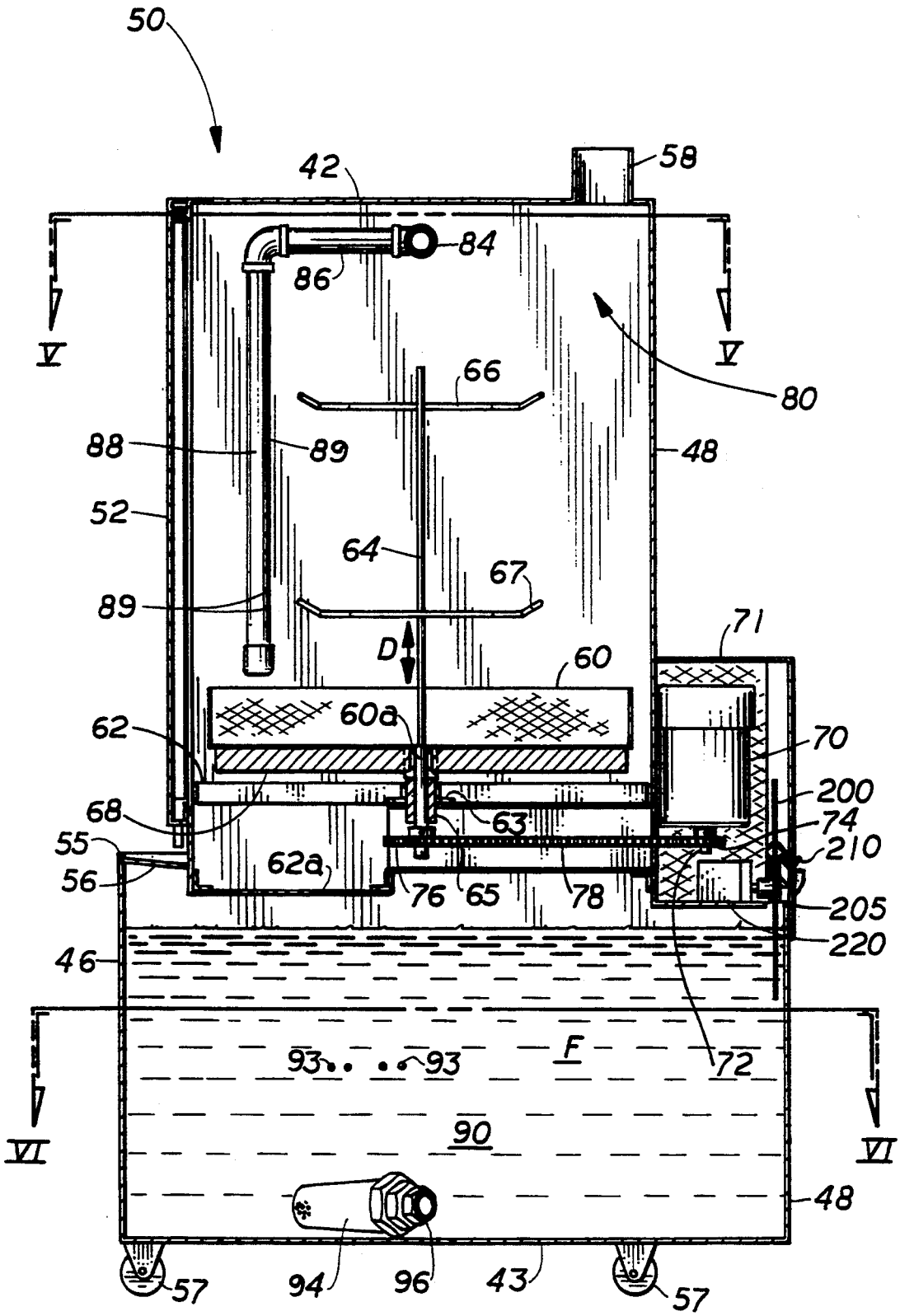
FIG. 4 is a side view of the cabinet portion of the parts washer with an exterior thereof cut away to reveal interior details of the cabinet portion.
Figure 5:
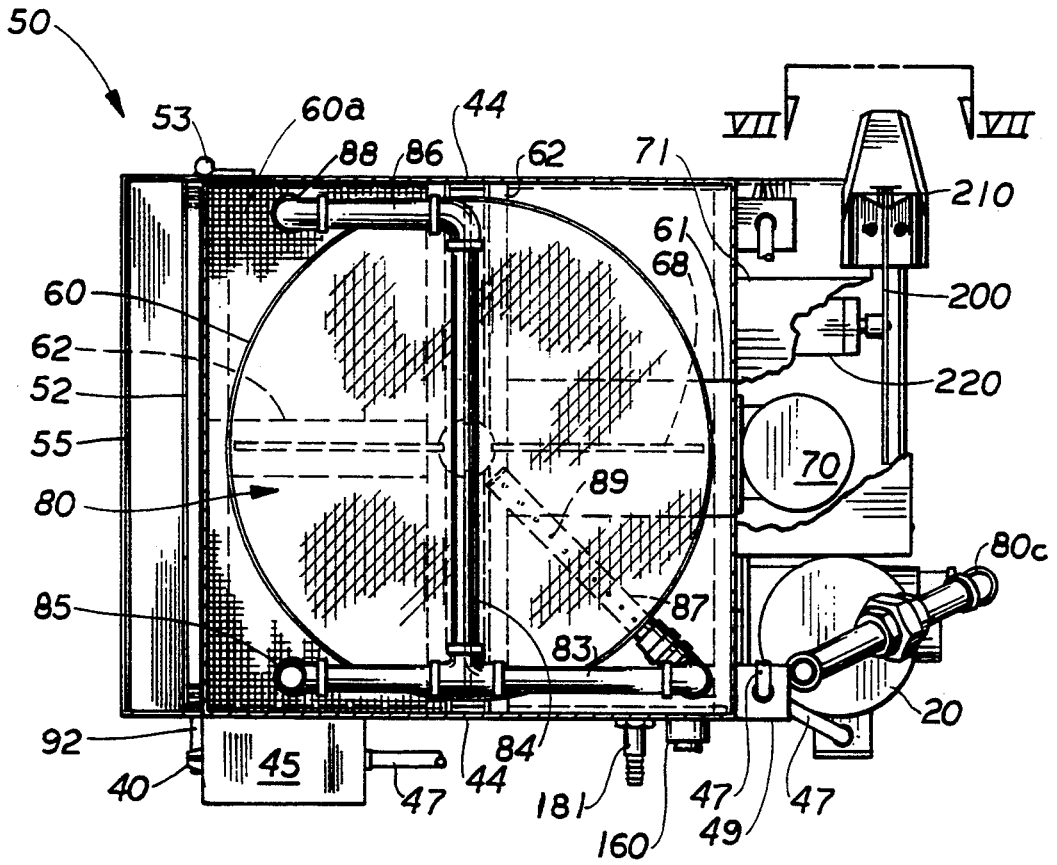
FIG. 5 is a sectional view taken along lines V—V of FIG. 4 which reveals details of the carousel within the cabinet portion.

The parts tree 64 extends down into the arbor 60*a* (see FIG. 4). The shelf 61 supports the carousel support 62 and also provides a shield for a chain 78 and carousel sprockets 76 (described in detail below) which drive the carousel 60. FIG. 5 reveals that the shelf 61 does not extend entirely across the cabinet 50, but rather only extends horizontally from the carousel drive motor 70 to slightly beyond the parts tree 64.

A sleeve 65 surrounds the arbor 60*a* which receives the parts tree 64 and sleeve 65. The sleeve 65 and a bearing 63 adjacent the arbor 60*a* are constructed such that the carousel 60 can easily rotate within the carousel support 62 allowing rotation within a horizontal plane, but preventing any linear displacement of the parts tree 64 and carousel 60.

A lower end of the arbor 60*a* includes the carousel sprocket 76 attached thereto. The carousel sprocket 76 engages the chain 78 which is driven by a drive sprocket 74 attached to an output shaft 72 of the carousel drive motor 70. Thus, a roller chain drive is provided. The sprockets 74, 76 are selected, along with a drive motor 70 speed, to preferably rotate the carousel 60 twice each minute. The carousel 60 rotation assembly 70, 72, 74, 76, 78 includes a manual slip drive to allow for safe operation of the carousel 60. The carousel drive motor 70 is enclosed within a cover 71 sheltering the carousel drive motor 70 during operation.

The carousel support 62 preferably does not entirely bisect the cabinet 50 but rather is formed from beams which extend between the side walls 44 and from the front wall 46 to the back wall 48. The support 62 has sufficient structural strength to adequately support the carousel 60 and parts tree 64.

A screen 60*a* bisects the cabinet 50 below the carousel 60 and has sufficient permeability to allow the cleaning fluid F to pass downward therethrough after discharge from the spray bar 80. The screen 60*a* has openings therein sized small enough so that small articles such as bolts and nuts are prevented from falling down into the reservoir 90.

Optionally, a sand trap may be included between the carousel 60 and the reservoir 90. The sand trap (not shown) has a mesh fine enough to prevent sand from passing therethrough and is removable for cleaning.

The spray bar network 80 supplies cleaning fluid F to the cabinet 50 through spray holes 89 for the cleaning of articles therein. Cleaning fluid F is supplied to the spray holes 89 from the spray bar pump 30 which is powered by the spray bar motor 20. Preferably the motor 20 is a one horsepower motor. A spray bar supply tube 80*c* directs the fluid F to a top of the cabinet 50 and along external horizontal piping 81 which supplies the cleaning fluid F to an entrance hole 82 and gives the cleaning fluid F access into the cabinet interior 51. A bracket 80*b* holds the supply tube 80*c* proximate to the cabinet 50.

The external horizontal piping 81 includes a valve 80*a* which allows cleaning fluid F delivery to be regulated by a user or be prevented entirely from entering the cabinet 50. A valve 128 is also interposed in the external horizontal piping 81 which can direct cleaning fluid F into a supply tube 126 leading to the sink 100 for use at the sink 100, as will be described below.

The entrance hole 82 is coupled to interior horizontal piping 83 which preferably parallels the external horizontal piping 81, but is located in the interior 51. The entrance hole 82 also is coupled to a first vertical spray bar 85 which depends vertically downward from the entrance hole 82 (see FIG. 5). The first vertical spray bar 85 includes orifices (not shown) which direct the cleaning fluid horizontally towards articles resting upon the carousel 60 and hanging from the parts tree 64.

The orifices are staggered to be placed close together. Preferably, the holes are 110/1000 of an inch in diameter. By making the holes this size, the one horsepower motor 20 can still adequately supply the fluid F. At this size, the fluid F is not ejected as a high velocity spray, but rather has a high flow rate, unlike other automatic parts washers. The high flow rate more effectively removes contaminants with a lesser power requirement. The reservoir 90 is sized to insure that the pump 30 never runs dry in spite of the high flow rate.

An end of the interior horizontal piping 83 distant from the entrance hole 82 includes a lower spray bar 87 attached thereto which depends downward vertically and then horizontally diagonally towards a center of the carousel 60. This lower spray bar 87 has spray holes 89 on an upper surface thereof which are orifices directing the cleaning fluid F spray upwards against articles suspended by the carousel 60 or parts tree 64.

The interior horizontal piping 83 includes an upper spray bar 84 which extends perpendicular to the interior horizontal piping 83 across to a side of the interior 51 distant from the interior horizontal piping 83. The upper spray bar 84 passes directly over a top of the parts tree 64. The upper spray bar 84 includes spray holes (not shown) on a lower surface thereof which direct the cleaning fluid downward toward articles resting upon the carousel 60 or supported by the parts tree 64.

An end of the upper spray bar 84 distant from the interior horizontal piping 83 includes a spray bar connector 86 and a second vertical spray bar 88 which are all operatively connected together to support the vertical spray bar 88 in a vertical position along a side of the interior 51 distant from the interior horizontal piping 83. Spray holes 89 in the second vertical spray bar 88 direct cleaning fluid F toward articles resting upon the carousel or hanging from the parts tree 64 from a different angle from that provided by the first vertical spray bar 85.

All of the spray bar piping 80*c*, 81, 83, 84, 85, 86, 87, 88 comprise the spray bar network 80 for the transfer of cleaning fluid F from the spray bar pump 30 to the spray holes 89 which direct the cleaning fluid F against the article to be cleaned. While the above-described configuration for the spray bar network 80 is preferred, other arrangements could also be utilized.

Figure 6:
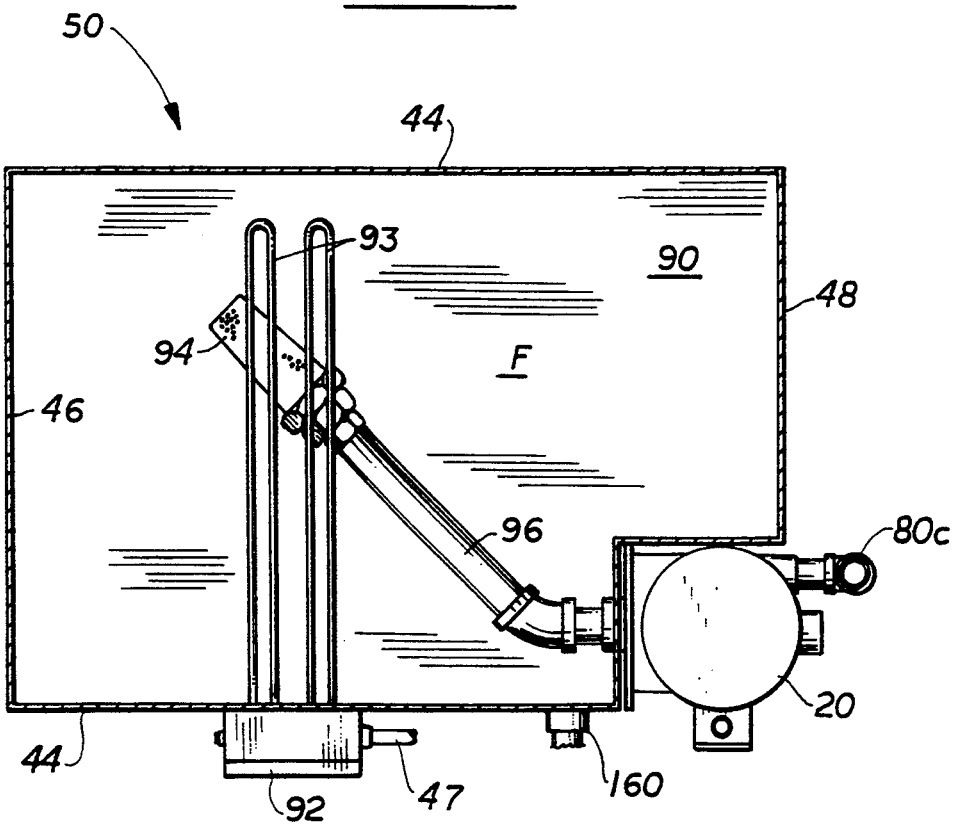
FIG. 6 is a sectional view taken along lines VI—VI of FIG. 4 which reveals details of the reservoir of this invention.

Referring now to FIGS. 4 and 6, details of the reservoir 90 are shown. The reservoir 90 includes a heater 92 with coils 93 in physical contact with the cleaning fluid F within the reservoir 90. This heater 92 heats up the cleaning fluid F, to preferably between 110° F. and 175°

F., for more effective cleaning of articles within the cabinet 50 and also within the sink 100 as will be described below. An intake pipe 96 to pump 30 is located at the bottom of the reservoir 90 with a strainer 94 surrounding an entrance to the intake pipe 96. The intake pipe 96 directs the cleaning fluid F to an inlet of the spray bar pump 30. Preferably, the reservoir 90 contains 47 gallons of fluid F and utilizes 6 to 8 pounds of biodegradable detergent mixed with water to form the fluid F.

Referring now to FIGS. 3 through 5 and 7, details of the skimmer 200 are shown in detail. The skimmer 200 is provided to remove sludge and other contaminants which either float on the cleaning fluid surface and/or readily adhere to surfaces. Skimmer 200 is a thin (preferably 16 gauge) stainless steel disc which is oriented within a reservoir rear access 205 such that the disc 200 is oriented in a vertical plane. The disc 200 is oriented with a portion above a surface of cleaning fluid F within the reservoir 90 and with a portion below the surface of the cleaning fluid F. This skimmer 200 rotates along arrow C and gathers sludge which comes in contact therewith.

The skimmer 200 includes a scraper 210 which impacts the skimmer 200 in a manner which allows it to remove sludge and other contaminants off of the skimmer 200 before it passes into the reservoir 90 for additional collection of contaminants. The scraper 210 then directs the sludge and other contaminants to a receptacle 230 for removal thereof either for disposal or recycling in some manner.

A skimmer motor 220 is provided which is operatively connected to the skimmer 200 and causes the skimmer 200 to rotate (preferably at approximately 6 revolutions per minute). The scraper 210 is mounted through the use of a scraper support 212, a trough 216 and an L-bracket 218 all coupled by an adjustment bolt 214 passing therethrough. Preferably, scrapers 210 are provided on each side of the skimmer 200 to remove sludge from both sides of the skimmer 200. The L-bracket 218 ensures that the scraper 210 remains in contact with the skimmer 200. The trough 216 directs the sludge toward the receptacle 230 after it is scraped off of the skimmer 200 by the scraper 210. A scraper support 212 is connected to the scraper 210 and trough 216 and allows the scraper 210 to be mounted to the cabinet 50. The disc 200 is distorted somewhat due to the high temperature of the fluid F. The L-bracket 218 supplies sufficient force to the scraper 210 (which is preferably stainless steel) to keep the scraper 210 adjacent the disc 200 at all times, in spite of this distortion.

Figure 2:
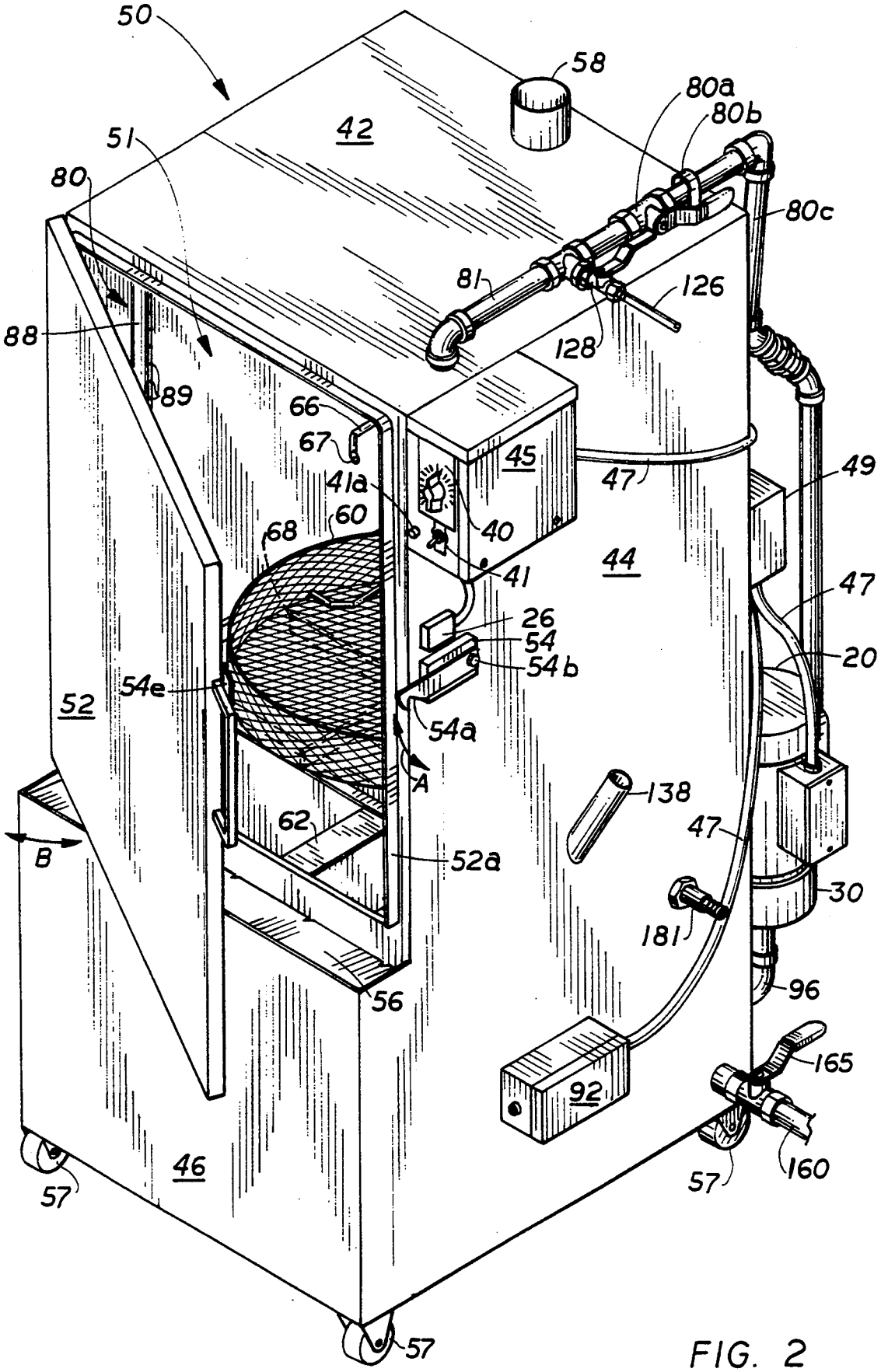
FIG. 2 is an isometric view of the cabinet portion of this invention revealing details of the cabinet portion.

Referring now to FIGS. 1 through 3, details of electricity supply and control of the parts washer 10 is shown. A plug 24 connected to a cord 47 supplies electric power to an electric box 22 mounted on the back wall 48 of the cabinet 50. The electric box 22 has two cords 47 exiting therefrom. One cord 47 connects to a side box 45 mounted on one of the side walls 44. The box 45 has a timer 40 thereon and a power switch 41. The power switch 41 and timer 40 determine whether the cabinet 50 is in operation. A power light 41a on the box 45 indicates when the switch 41 and timer 40 are directing power to the cabinet 50 for operation. The disrupter 26 is connected to the side box 45 and can disrupt the cabinet 50 operation when the door 52 is opened.

A second cord 47 exits from the electric box 22 and leads to a junction 49 supplying power to the motors 20, 70, 220 and heater 92 for operation of various portions of the parts washer 10. The junction 49 can also connect to the filter pump 175 (FIG. 8) for operation thereof. An auxiliary timer 240 allows a user to set a different time of operation for equipment such as the filter 150 or the skimmer 200. This allows these devices to operate longer than the spray bar 80 and carousel 60 and further cleanse the fluid F.

Figure 8:
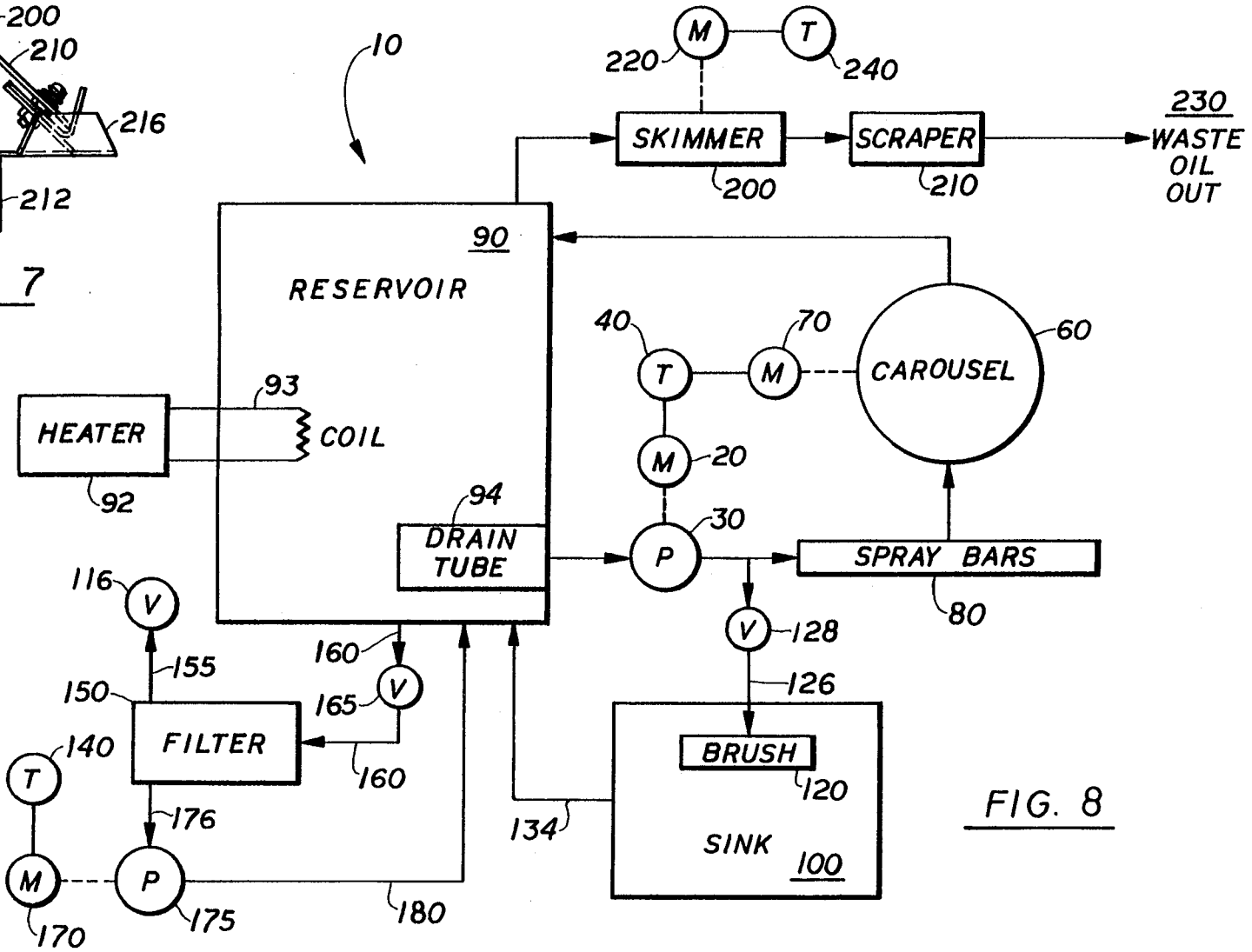
FIG. 8 is a schematic revealing details of the fluid delivery system and other systems of the parts washer of this invention.
Figure 7:
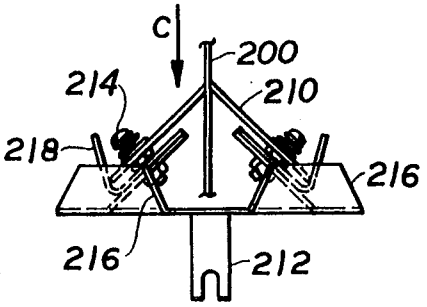
FIG. 7 is a sectional view taken along lines VII—VII of FIG. 5 which reveals details of a skimmer of this invention.

Referring now in detail to FIGS. 1, 2 and 8, details of the filter 150 are shown. The filter 150 is provided to remove contaminants from the cleaning fluid F which is stored within the reservoir 90. The filter 150 includes a filter inlet 160 in fluid communication with the reservoir 90 through an inlet valve 165. A filter motor 170 and filter pump 175 cause cleaning fluid F to be drawn through the filter inlet 160 and into the filter 150. A pump inlet 176 connects the filter 150 to the pump 175. A filter outlet line 180 returns fluid F passing through the filter pump 175 back to the reservoir 90 through a connector 181 mounted in the side wall 44.

One filter which adequately performs the functions of the filter 150 is described in detail in U.S. Pat. No. 4,911,190 to Sheldon. This filter 150 includes a compartment which receives soiled shop towels therein. These shop towels are then utilized to strain contaminants out of the cleaning fluid F passing therethrough. As a result, the cleaning fluid F is cleansed of contaminants and soiled shop towels are put to use before their disposal, recycling or commercial cleaning. In this way, the user of the parts washer 10 will be assured that any contaminants will be properly disposed of.

FIG. 1 also reveals details of the sink 100. The sink 100 includes a basin 110 with a back splash 112 and walls 118 surrounding the basin 110. The walls 118 are significantly lower than the back splash 112. The back splash 112 allows the sink 100 to be located adjacent a wall without contaminants removed from the articles splashing against the wall. The sink 100 is supported upon legs 114. Preferably, the legs 114 allow for stationary location of the sink 100. However, the legs 114 could also include wheels as does the cabinet 50 for portability of the entire parts washer 10.

A supply tube 126 coupled to the spray bar 80 through the valve 128 supplies cleaning fluid F to the sink 100. The valve 128 is hand operable and is preferably positioned near the sink 100 so a user can adjust the valve 128 to meet fluid F flow rate requirements. The supply tube 126 passes through a brush support hole 113 in the back splash 112 and includes a brush 120 on an end of the supply tube 126 opposite the valve 128. The brush 120 includes a handle 122 for easy grasping by a user and a nozzle 121 at a tip thereof for discharge of the cleaning fluid F. The nozzle 121 is surrounded by bristles 124 which can be manually used by the user to further encourage contaminants to be dislodged from the article to be cleaned.

The basin 110 includes a drain 130 for removal of the cleaning fluid F captured by the basin 110. The drain 130 is in fluid communication with a conduit 134 which telescopes within a cabinet port 138 (FIG. 2), thus allowing fluid passing through the drain 130 to be directed back into the reservoir 90. Accordingly, the reservoir 90 is part of a cleaning system which can either utilize the cabinet 50 or the sink 100 for cleaning of articles.

Referring now to FIG. 8, details of the operation of the parts washer 10 and of the fluid delivery system 250 are described. Initially, a user identifies an article to be cleaned and determines whether that article can be automatically cleaned within the cabinet 50 (FIG. 1) which includes the carousel 60 or will require manual cleaning within the sink 100. If automatic cleaning within the carousel 60 is indicated, other articles may be simultaneously cleaned within the sink 100.

The articles are placed within the carousel 60 and the door 52 (FIG. 1) is closed. The cabinet 50 is then sealed using the latch 54 (FIG. 1). The motor 20 which drives the pump 30 is then utilized to activate the spray bar network 80. The valve 80*a* (FIG. 2) is checked to make sure that it is in the open position. Cleaning fluid F then passes through the pump 30, through the spray bar network 80 and is directed against articles within the carousel 60. The carousel 60 is rotated by the motor 70. This process continues for as long as a timer 40 is set to operate. When the timer 40 indicates that the set time has elapsed, the motors 20, 70 are turned off and the cleaned articles can be removed from the cabinet 50.

During the cleaning process, a heater 92 utilizes a coil 93 to heat the cleaning fluid F within the reservoir 90. The heater 92 can be adjusted to heat the cleaning fluid F to the desired temperature. The cleaning fluid F is supplied through the intake pipe 94 to the pump 30 for use through the spray bar network 80.

Simultaneously, some fluid F within the reservoir 90 is passed through the filter inlet 160 and through the inlet valve 165 to pass through the filter 150 for cleansing thereof. An air bleed valve 116 ensures that any air within the filter 150 is bled out during utilization of the filter 150. A pump inlet 176 directs the fluid F to a pump 175 which is driven by the filter motor 170. The cleaning fluid F is then returned to the reservoir 90 through a filter outlet line 180.

The filter 150 is controlled by a timer 140 which is coupled to the motor 170. The timer 140 can be set to operate for as long as the timer 40 or may be utilized for a longer or shorter period depending on the filtration needs of the fluid F within the reservoir 90.

The skimmer 200 is rotated by the motor 220 which is controlled by the timer 240. The skimmer 200 pulls contaminants out of the cleaning fluid F within the reservoir 90 and these contaminants are scraped off of the skimmer 200 by the scraper 210 and then disposed of within the receptacle 230 (FIG. 3). The skimmer 200 can operate for a time similar to that programmed into the timer 40 or the timer 240 can be used to provide a longer or shorter period of operation of the skimmer 200.

If manual cleaning within the sink 100 is indicated, the valve 128 is opened while the pump 30 is in operation allowing cleaning fluid F to pass through the supply tube 126. Cleaning fluid F then passes through the brush 120 for discharge into the basin 110 of the sink 100. A user may manually locate an article within this flow of cleaning fluid F and utilize the bristles 110 (FIG. 1) to encourage the removal of contaminants from the article to be cleaned. Articles may simultaneously be washed within the cabinet 50.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A device for removing surface contaminants from articles comprising in combination:

a cabinet having an interior receiving the articles, said cabinet including means for automatically delivering cleaning fluid to clean the articles;

a sink having a basin for supporting articles and a means for manually delivering said cleaning fluid to clean the articles; and a reservoir operatively coupled to both said sink and said cabinet, said reservoir capturing said cleaning fluid after use within said cabinet and after use within said sink, said reservoir including means to provide cleaning fluid such that cleaning fluid is recycled from said reservoir for reuse.

2. The device of claim 1 including a filter operatively coupled to the device such that the cleaning fluid cycles through the filter removing contaminants from the fluid.

3. A device for removing surface contaminants from articles comprising in combination:

a cabinet having an interior receiving the articles, said cabinet including means for automatically delivering cleaning fluid to clean the articles;

a sink having a basin for supporting articles and a means for manually devlivering said cleaning fluid to clean the articles; and a reservoir operatively coupled to both said sink and said cabinet, said reservoir capturing said cleaning fluid after use within said cabinet and after use within said sink, wherein said device includes a filter operatively coupled to the device such that the cleaning fluid cycles through the filter removing contaminants from the fluid, and wherein said reservoir provides cleaning fluid to said means for automatically delivering cleaning fluid and said means for manually delivering said cleaning fluid such that cleaning fluid utilized within said cabinet and said sink is recycled from said reservoir for reuse.

4. The device of claim 3 wherein said manual fluid delivery means is supplied with fluid by operation of a valve interposed within said automatic fluid delivery means.

5. The device of claim 3 wherein said filter has an input coupled to said reservoir and an output coupled to said reservoir, said filter including a pump for forcing fluid flow through said filter.

6. The device of claim 3 wherein said reservoir includes an access portal, said access portal having a skimmer disc therein partially submerged within the fluid held within the reservoir, said skimmer disc having a scraper abutting thereagainst on opposite side surfaces thereof, such that upon rotation of said skimmer disc contaminants within the reservoir and adhering to the disc are brought out of the reservoir, scraped off of the disc by the scrapers and removed from the reservoir.

7. The device of claim 3 wherein said cabinet includes a rotating carousel therein, the carousel rotating in a substantially horizontal plane, said cabinet including a door which closes said cabinet such that the carousel resides within a closed environment with said means for automatically delivery cleaning fluid oriented to provide the cleaning fluid within said interior of the cabinet, said cabinet in fluid communication with the reservoir at a lower portion of the cabinet below the carousel.

8. The device of claim 7 wherein said reservoir includes heating means, whereby fluid within the reservoir is heated for more effective cleaning;

wherein said carousel is rotated by a carousel motor;

wherein said means for automatically delivering cleaning fluid is a network of spray bars comprised of substantially tubular structures with a plurality of small orifices therein, the spray bars and said orifices oriented such that fluid within the spray bars is ejected out of the orifices and toward an article resting upon the carousel, said spray bars in fluid communication with the outlet of a pump which receives fluid from the reservoir, said pump supplying fluid to the spray bars is controlled by a spray bar motor; and wherein the carousel motor and spray bar motor are coupled to a timer whereby the operation of the cabinet is terminated upon the elapsing of a specified amount of time programmed into said timer, thereby stopping flow of fluid through the spray bars and rotation of the carousel simultaneously.

9. The device of claim 3 wherein said means for automatically delivering cleaning fluid is a network of spray bars comprised of substantially tubular structures with a plurality of small orifices therein, the spray bars and said orifices oriented such that fluid within the spray bars is ejected out of the orifices and toward an article resting upon the carousel, said spray bars in fluid communication with the outlet of a pump which receives fluid from the reservoir.

10. The device of claim 9 wherein said means for manually delivering cleaning fluid is a fluid supply tube receiving fluid through a valve interposed within the spray bars of the automatic fluid delivery means and with an end of the tube distant from the valve having an outlet nozzle thereon, the outlet nozzle including a handle for easy grasping by a user and a plurality of bristles at a tip thereof through which the cleaning fluid passes, said tube supported above the sink by passing through a brush support hole located in a back splash of the sink;

whereby a user can manually apply fluid to a part to be cleaned and utilize the bristles of the nozzle to further encourage the removing of contaminants from the article.

11. A device for removing surface contaminants from articles comprising, in combination:

a cabinet having an interior receiving the articles, said cabinet including means for automatically delivering cleaning fluid to clean the articles;

a sink having a basin for supporting articles and a means for manually delivering said cleaning fluid to clean the articles; and a reservoir operatively coupled to said cabinet, said reservoir capturing said cleaning fluid after use within said cabinet, said reservoir including means to provide cleaning fluid to said means for automatically delivering cleaning fluid such that cleaning fluid is recycled from said reservoir for reuse, and wherein a fluid coupling means is interposed between said reservoir and said sink, such that said reservoir can capture cleaning fluid after use within said sink, said reservoir including means to provide cleaning fluid to said means for manually delivering said cleaning fluid such that cleaning fluid utilized within said cabinet and said sink is recycled from said reservoir for reuse.

12. The device of claim 11 wherein said manual fluid delivery means is supplied with fluid by operation of a valve interposed within said automatic fluid delivery means.

13. The device of claim 12 including a filter operatively coupled to the device such that the cleaning fluid cycles through said filter removing contaminants from the fluid.

14. The device of claim 13 wherein said filter has an input coupled to said reservoir and an output coupled to said reservoir, said filter including a pump forcing fluid flow through said filter.

15. The device of claim 14 wherein said reservoir includes an access portal, said access portal having a skimmer disc therein partially submerged within the fluid held within the reservoir, said skimmer disc having a scraper abutting thereagainst on opposite side surfaces thereof, such that upon rotation of said skimmer disc contaminants within said reservoir and adhering to said disc are brought out of said reservoir, scraped off of said disc by said scrapers and removed from said reservoir.

16. The device of claim 15 wherein said cabinet includes a rotating carousel therein, the carousel rotating in a substantially horizontal plane, said cabinet including a door which closes said cabinet such that the carousel resides within a closed environment with said means for automatically delivery cleaning fluid oriented to provide the cleaning fluid within said interior of said cabinet, said cabinet in fluid communication with said reservoir at a lower portion of said cabinet below said carousel.

17. The device of claim 16 wherein said means for automatically delivering cleaning fluid is a network of spray bars comprised of substantially tubular structures with a plurality of small orifices therein, said spray bars and said orifices oriented such that fluid within said spray bars is ejected out of said orifices and toward an article resting upon said carousel, said spray bars in fluid communication with the outlet of a pump which receives fluid from said reservoir.

18. The device of claim 17 wherein said means for manually delivering cleaning fluid is a fluid supply tube receiving fluid through a valve interposed within said spray bars of the automatic fluid delivery means and with an end of said tube distant from said valve having an outlet nozzle thereon, said outlet nozzle including a handle for easy grasping by a user and a plurality of bristles at a tip thereof through which the cleaning fluid passes, said tube supported above said sink by passing through a brush support hole located in a back splash of said sink;

whereby a user can manually apply fluid to a part to be cleaned and utilize said bristles of said nozzle to further encourage the removing of contaminants from the article, and wherein said reservoir includes heating means, whereby fluid within said reservoir is heated for more effective cleaning;

wherein said carousel is rotated by a carousel motor;

wherein said pump supplying fluid to said spray bars is controlled by a spray bar motor; and wherein said carousel motor and said spray bar motor are coupled to a timer whereby the operation of said cabinet is terminated upon the elapsing of a specified amount of time programmed into said timer, thereby stopping flow of fluid through said spray bars and rotation of said carousel simultaneously.

19. The device of claim 1 wherein said reservoir includes an inlet means on said reservoir to receive cleaning fluid from said delivery means and an outlet on said reservoir to direct cleaning fluid to said delivery means, such that the cleaning fluid is maintained within a closed system.

* * * * *